US006370711B1

(12) United States Patent
Ferrer Beltran

(10) Patent No.: US 6,370,711 B1
(45) Date of Patent: Apr. 16, 2002

(54) ASSEMBLY FOR WASHSTAND

(75) Inventor: Jose Mª Ferrer Beltran, Bonrepos (ES)

(73) Assignee: Ibergesfer, S.L. (ES)

( * ) Notice: Subject to any disclaimer, the term of this patent is extended or adjusted under 35 U.S.C. 154(b) by 0 days.

(21) Appl. No.: 09/632,124

(22) Filed: Aug. 3, 2000

(30) Foreign Application Priority Data

Apr. 5, 2000 (EP) ..... 00500056

(51) Int. Cl.[7] ..... E03C 1/326
(52) U.S. Cl. ..... 4/646; 4/648
(58) Field of Search ..... 4/631, 643, 646, 4/647, 648

(56) References Cited

U.S. PATENT DOCUMENTS

| | | | | |
|---|---|---|---|---|
| 550,239 A | * | 11/1895 | Allen | 4/646 X |
| 639,066 A | * | 12/1899 | Lloyd | 4/646 X |
| 2,504,271 A | * | 4/1950 | Maguire | 4/646 X |
| 2,535,613 A | * | 12/1950 | Vanderbeek | 4/646 X |
| 2,836,831 A | * | 6/1958 | Hurwitz | 4/646 X |

FOREIGN PATENT DOCUMENTS

| | | | | |
|---|---|---|---|---|
| GB | 860747 | * | 2/1961 | 4/648 |

* cited by examiner

*Primary Examiner*—Robert M. Fetsuga
(74) *Attorney, Agent, or Firm*—Lackenbach Siegel

(57) ABSTRACT

Assembly for washstand, with different mounting options obtained through combinations of deep or shallow basins, straight or cut-out countertops and supported on legs or on a stand, as well as for free-standing basins. Its basic functional elements are the basin proper, with the configuration of a shell with spherical surface, deep (1) or shallow (2); and the planar countertop, with several possible configurations of its front edge. The support legs (7) are cylindrical and tubular, provided with a horizontal cross piece (12) that is supported against the wall. The countertops are affixed to the wall by means of back supports (13) of compound profile, that are inserted into lugs (8) in the lower face of the countertop and are fastened to the wall. If the countertop is cut out, the basin is supported on a central bracket (20) fastened to the wall by means of a special member (22); and if the basin is free-standing, it is supported on another similar bracket (31).

10 Claims, 10 Drawing Sheets

ASSEMBLY FOR WASHSTAND

SUBJECT MATTER

The subject matter to which the present patent relates comprises an "assembly for a washstand," with preferred application into a complete unit.

BACKGROUND

Numerous assemblies are known which are applicable to the formation of bathroom washstands, which differ from one another on the basis of the configuration of the basin itself as well as of the nature, number and disposition of the complementary elements, their mechanical (supporting), functional or decorative characteristics.

It is implicit n the foregoing text that any assembly for a washstand can be considered to comprise, in broad and general terms, the following parts or elements:

the receptacle for which it is named (washbasin), an upper panel (countertop) disposed horizontally for holding toiletry articles, elements for affixing and mechanically supporting both the basin and the countertop.

In some cases, the space between the bottom of the countertop and the floor can be used to complement the stand with storage space, such as cabinets or drawers, for toiletry articles. In such cases, the countertop viewed from above, in terms of form and dimension, reproduces the configuration of the upper plane of the stand.

Within this generic assembly are possible numerous aesthetic variations which affect the nature and form of the structural elements, giving rise to numerous compositions differentiated by their conception and their layout, among which compositions, with distinguishing characteristics, is the assembly protected under this Patent.

DESCRIPTION OF THE INVENTION

The object of the invention forming the subject matter of this patent comprises providing an assembly for a basin which, within the necessary generic composition, is notable for the singularities of layout of its functional components, which, in turn, affect the originality of the solutions employed for the mechanical components.

The original assembly to be protected comprises the following elements:

Functional Elements

A basin assuming the configuration of a shell having a spherical surface with its i concavity facing upwardly, in two distinct shapes for alternative use: one of lesser maximum diameter and greater depth, and the other with greater maximum diameter and lesser depth. The former is conventionally referred to as a "deep basin" and the latter as a "shallow basin." Both can be mounted with or without countertops.

Planar countertop, disposed horizontally, wider than it is deep, with a straight rear edge for adaptation to the facing of the wall against which it is placed, the lateral edges perpendicular to the back and the front edge with one of the following alternative configurations:

straight, parallel to the back edge, in three sections: the central section straight and recessed and the ends curved convexly and identical.

In addition, the two preceding configurations (straight countertops) can have an incomplete circumferential hollowed-out approach in the center of their front edge (cutout countertops).

Mechanical Elements

These have the common purpose of supporting the functional elements and are as follows:

For use with any type of countertop

Two cylindrical, tubular, vertical legs disposed in the longitudinal axis of the countertop and perpendicularly to its plane at its lower face in the proximity of its lateral edges affixed to it by means of two lugs joined to said lower face, which are inserted into sockets holding the upper ends of the legs and retaining them by means of set screws engaging grooves around the perimeter of the lugs.

Each leg is provided with a horizontal, cylindrical, tubular cross piece which has a smaller diameter than the leg, with one of its ends introduced into the leg at approximately one third of its height and the other end supported against the wall to compensate for any potential frontal pressure on the basin to which it might be subjected during its use.

Two compound profile supports, whose cross section has the form of an inverted "U," the inner shank of which extends outwardly and downwardly in a double right angle, for the purpose of fastening the straight rear edge of the countertop, set against the wall and affixed to it with two fasteners through the downward extension of the inner shank of the "U," which are joined to the lower face of the countertop by means of two lugs affixed to it, which are inserted into an opening in the central section of the "U" and are retained by set screws engaging grooves around the perimeter of the lugs.

These supports are also utilized for affixing the support bracket to the wall in a manner yet to be described.

Only for use with straight countertops

A vertical, cylindrical, tubular support, one of the ends of which supports the basin at the center of its outer face (outlet) and the opposite end of which is supported on the countertop.

Only for use with cut-out countertops, on legs

A central support bracket to support the basin from underneath the countertop, where it has its incomplete circumferential hollowed-out approach. On the projecting flange the upper face of which is arched concavely, it has a circular lower perforation for the drain to pass through, and its vertical face set against the wall is hollow and affixed to it by means of a special member described below.

A special member for affixing brackets to the wall, in a flat, rectangular shape, with its shorter sides bent such as to form obtuse angles. In the center of its edge there is a reinforcement projection, and in the proximity of the vertices of the planar face are two holes for inserting the fastening screws, with the downward extension of the inner shank of the support, shaped in cross section like an inverted "U", interspaced between the wall and the member, with its hole coinciding with one of the upper holes of the member, such that the same screw can join both the member and the support to the wall.

A vertical, cylindrical, tubular support, on one end of which the basin is supported at the center of its outer face (outlet) and the opposite end of which is supported on the horizontal flange of the attachment bracket.

Only for use with a straight or cut-out countertop, with convexly curved front edges A three-body stand in which the two ends are symmetrically inverse, with each having a drawer in the upper portion and a cabinet in the lower portion, and they are joined at the central body, the upper plane of which is slightly lower than that of the end bodies.

The rear plane of the stand is adapted to the facing of the wall and its lateral planes are perpendicular to the back, with the front being curved convexly at its two end bodies and vertically flat and its center body recessed with respect to said end bodies.

A vertical, cylindrical, tubular support, on one end of which is supported the basin at the center of its outer face (outlet) and the opposite end of which is supported on the upper face of the central body of the stand, can assume two distinct heights: a short support for a deep basin and long support for a shallow basin.

Two identical cylindrical supports, on one end of each of which is supported the countertop and whose opposite ends support the center of each of the two end bodies of the stand, keeping the countertop spaced apart from the upper plane of the stand and parallel to it.

For use with any type of countertop

With a support for faucet fixtures formed by: a flat upper face that is rectangular and horizontal, with a large, central opening for affixing a single-handle faucet; two flat, tapering, vertical lateral faces, whose longer straight side is placed against the wall, the intermediate side of which extends along the upper face and the short side of which extends along the open base; the front face is arched concavely and comprises two through-holes through which are introduced two screws that affix it to the wall.

Only for use without countertops (free-standing basins)

A support bracket similar to the one described under C, but with the upper face of the projecting flange having greater concavity, with reinforcing ribs on its lower face, with the higher flat section of said upper face having a larger surface area with a small projection extending over its concavity.

C) Aesthetic Elements

These are embellishments intended to conceal those aspects of the mechanical and functional elements that could detract from the aesthetic appearance of the assemblage. These are:

Only for use with countertops on legs or free-standing basins

A cylindrical, tubular outlet at the lower end of which a tubular member leading to the trap is pressure-connected with a peripheral seal.

A cap to mask the basin's outlet opening, in the shape of a concave disk detachably connected to a socket disposed in the center of radii within the upper delimitation of the outlet.

BRIEF DESCRIPTION OF THE DRAWINGS

To complete the description of the invention and to facilitate understanding its formal, structural and functional characteristics, drawings are enclosed in which are schematically depicted different aspects of a preferred embodiment of the assembly for the washstand which is the subject matter of this patent.

The drawings provide the following representations:

FIG. 3, a section along the longitudinal axis; and FIG. 4, in top view.

FIG. 6 is a longitudinal section along a vertical plane and FIG. 7 is a longitudinal section along the axis of the cross piece sectioned along a horizontal plane and projected in top view.

FIG. 9 is a view from below; FIG. 10 is a view in longitudinal section; FIG. 11 viewed from above; FIG. 12 viewed from the back; FIG. 13 in lateral view; and FIG. 14 in perspective view.

FIG. 16 in a view from below; FIG. 17 in longitudinal section; FIG. 18 in a view from above; FIG. 19 in a view from the back; FIG. 20 in lateral view; and FIG. 21 in perspective view.

FIG. 22 in front view; FIG. 23 in a view from above; FIG. 24 in lateral view; FIG. 25 in profile section; and FIG. 26 in perspective view.

FIG. 27 in a view from below; FIG. 28 in longitudinal section; FIG. 29 in a view from the front; FIG. 30 in a view from above; FIG. 31 in lateral view; FIG. 32 in front perspective; and FIG. 33 in back perspective.

FIG. 34 in a view from above; FIG. 35 in a lateral view; FIG. 36 in a section along the longitudinal axis; and FIG. 37 in perspective view.

DESCRIPTION OF A PREFERRED EMBODIMENT

To clearly demonstrate the nature and scope of the advantageous application of the assembly for the washstand which represents the subject matter of this invention, in the following is found a description of its composition and mounting with reference to the drawings which, since they represent and provide information about a preferred embodiment of said subject matter, must be considered in their broadest sense and not as limiting the scope of the application or the content of the invention.

A)—Functional Components

Figure 1:
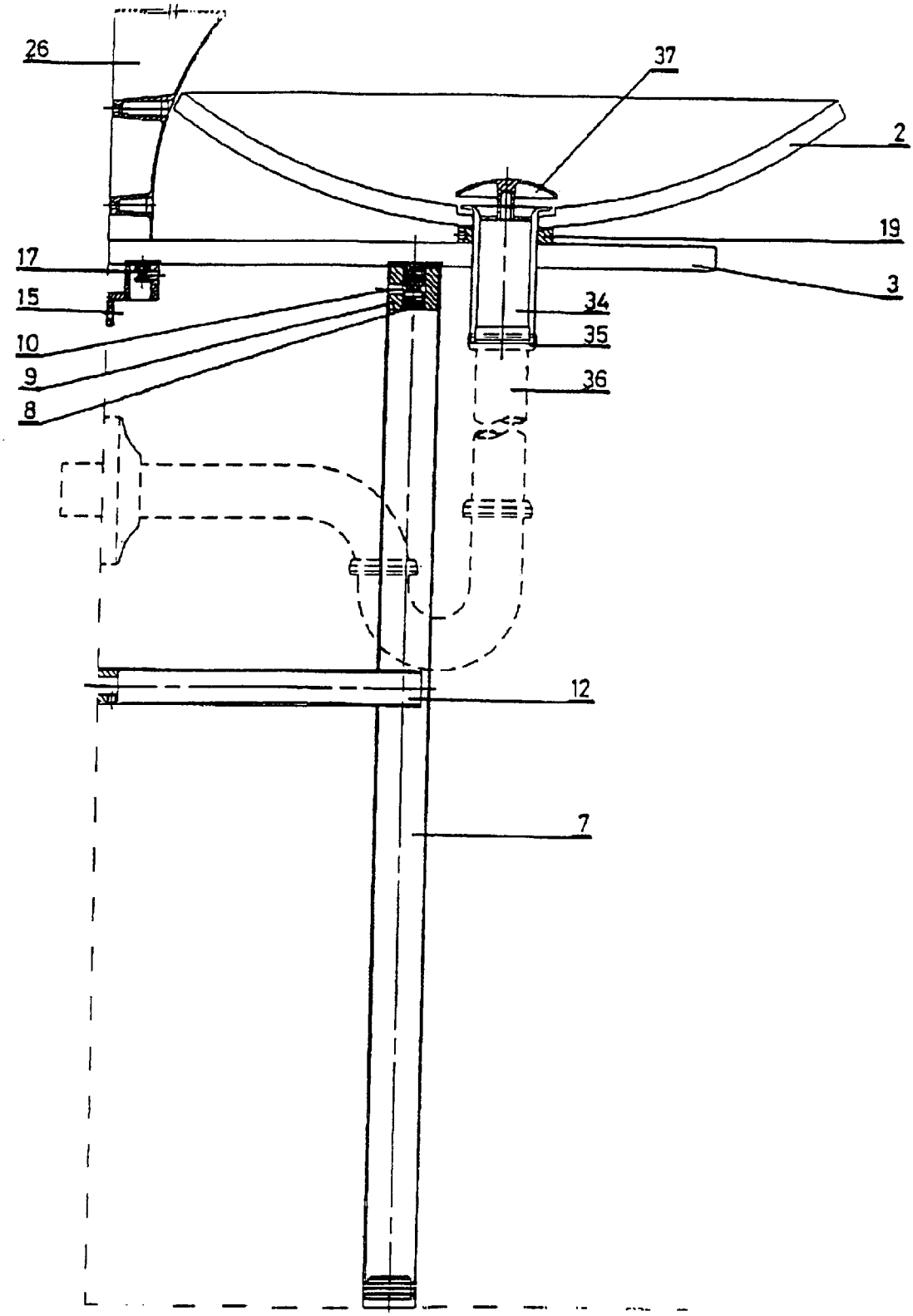
FIG. 1: Variant of shallow basin mounting, straight countertop and legs: in elevation, sectioned along several vertical planes.

The assembly comprises the following functional components:

A basin with the configuration of a shell with spherical surface with its concavity facing upwardly, in two distinct forms for alternative use: one (1) (FIG. 8) with lesser maximum diameter and greater depth; and the other (2) (FIG. 1) with greater maximum diameter and lesser depth (shallow).

A planar countertop, disposed horizontally, wider than it is deep, with its back edge straight, the lateral edges perpendicular to the back and the front edge with one of the following four alternative configurations: Straight (3) (FIG. 1), parallel to the back edge; or with a straight, recessed, central section (4); and the ends (5) in identical convex curves; or any of the two preceding configurations (straight countertops) with an incomplete circumferential hollowed-out approach (6) (FIG. 8) in the central region (cut-out countertops).

B)—Mechanical Components

To support the functional components, the following mechanical elements are included:

For use with any type of countertop

Figure 6:
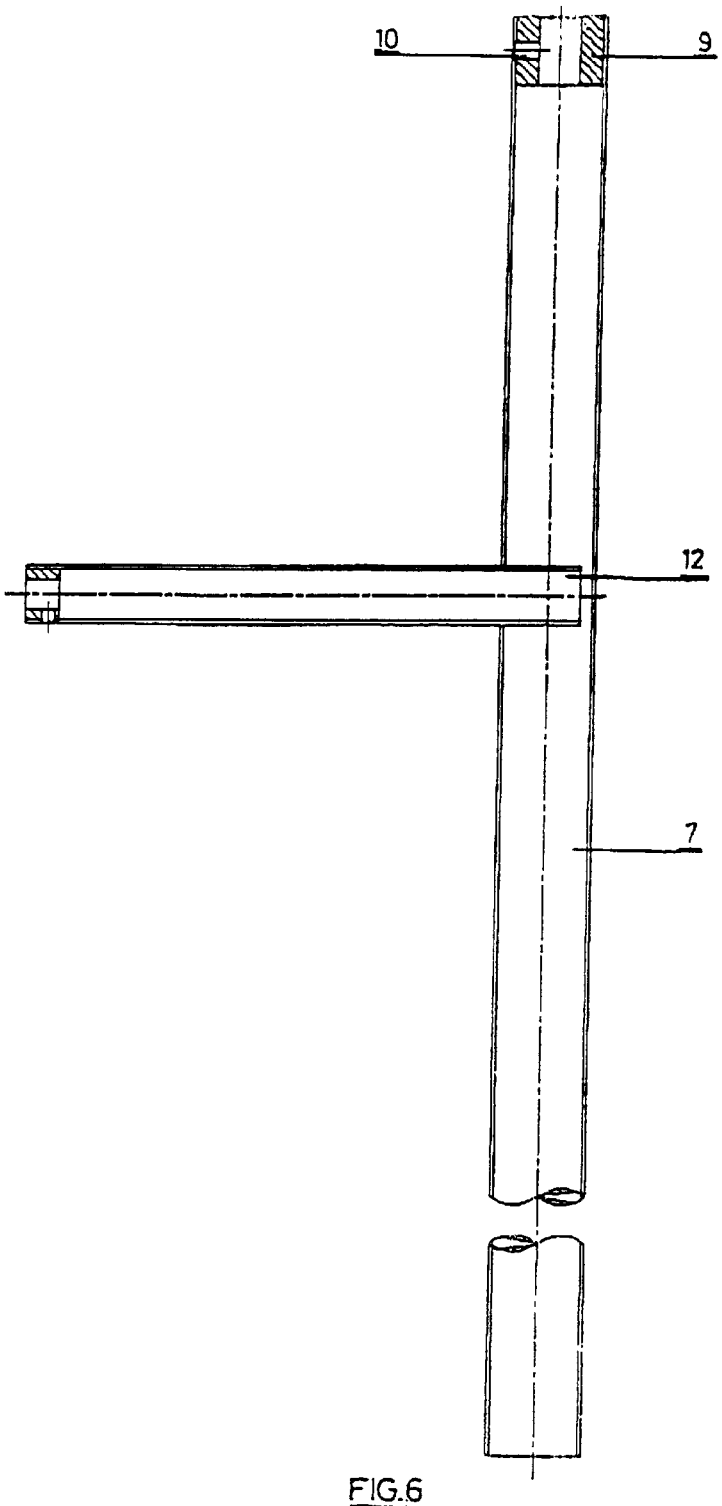
FIGS. 6 and 7: Support leg for countertops.

Two vertical, cylindrical, tubular legs (7) (FIG. 6) disposed in the longitudinal axis of the countertop, perpendicular to its plane at its lower face in the proximity of its lateral edges, affixed to it by means of lugs (8) joined to said lower face and inserted into sockets (9), that hold the upper ends of the legs (7) and retain them by means of set screws (10) engaging grooves (11) around the perimeter of the lugs (8).

Figure 7:
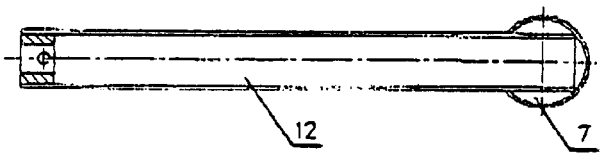

Each leg is provided with a horizontal, cylindrical, tubular cross piece (12) (FIG. 7) which has a lesser diameter than the leg, with one of the ends of the cross piece introduced into the leg, while the other is supported against the wall, bracing the assemblage.

Figure 2:
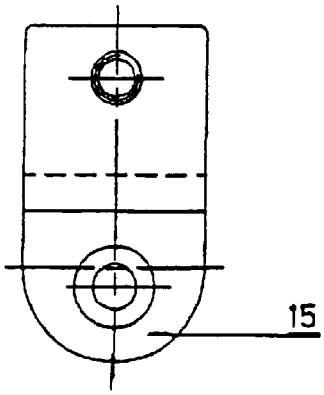
FIGS. 2 through 4: support for the rear region of the countertops, FIG. 2 in front view.
Figure 3:
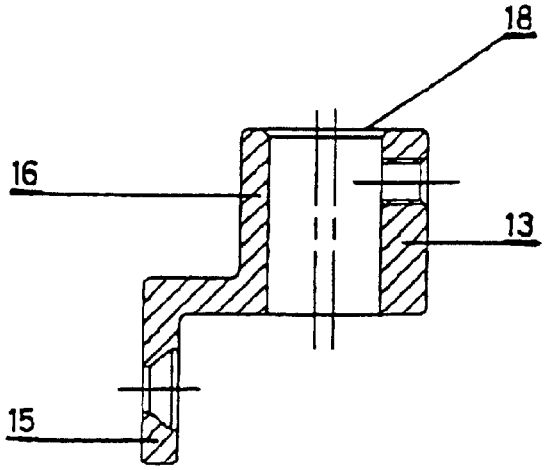
Figure 5:
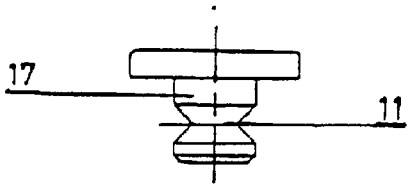
FIG. 5: Lug of the lower face of the countertop, inserted into the opening of the central branch of the "U" support, for its elevated connection.
Figure 4:
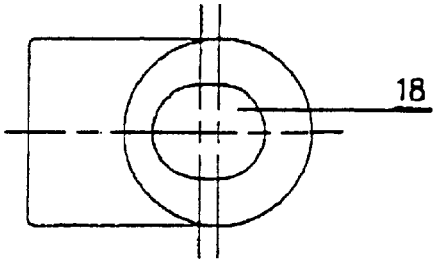

Two compound profile supports (FIGS. 2, 3 and 4), whose cross section has the form of an inverted "U" (13), the inner shank of which extends outwardly and downwardly in a double right angle, affixed to the wall with two fasteners (14) through the downward extension (15) of the inner shank (16) of the "U," and which are joined to the lower face of the countertop by means of lugs (17) (FIG. 5) affixed to it and which are inserted into an opening (18) of the central section and are retained by set screws engaging grooves (11) around the perimeter of the lugs (17).

Figure 8:
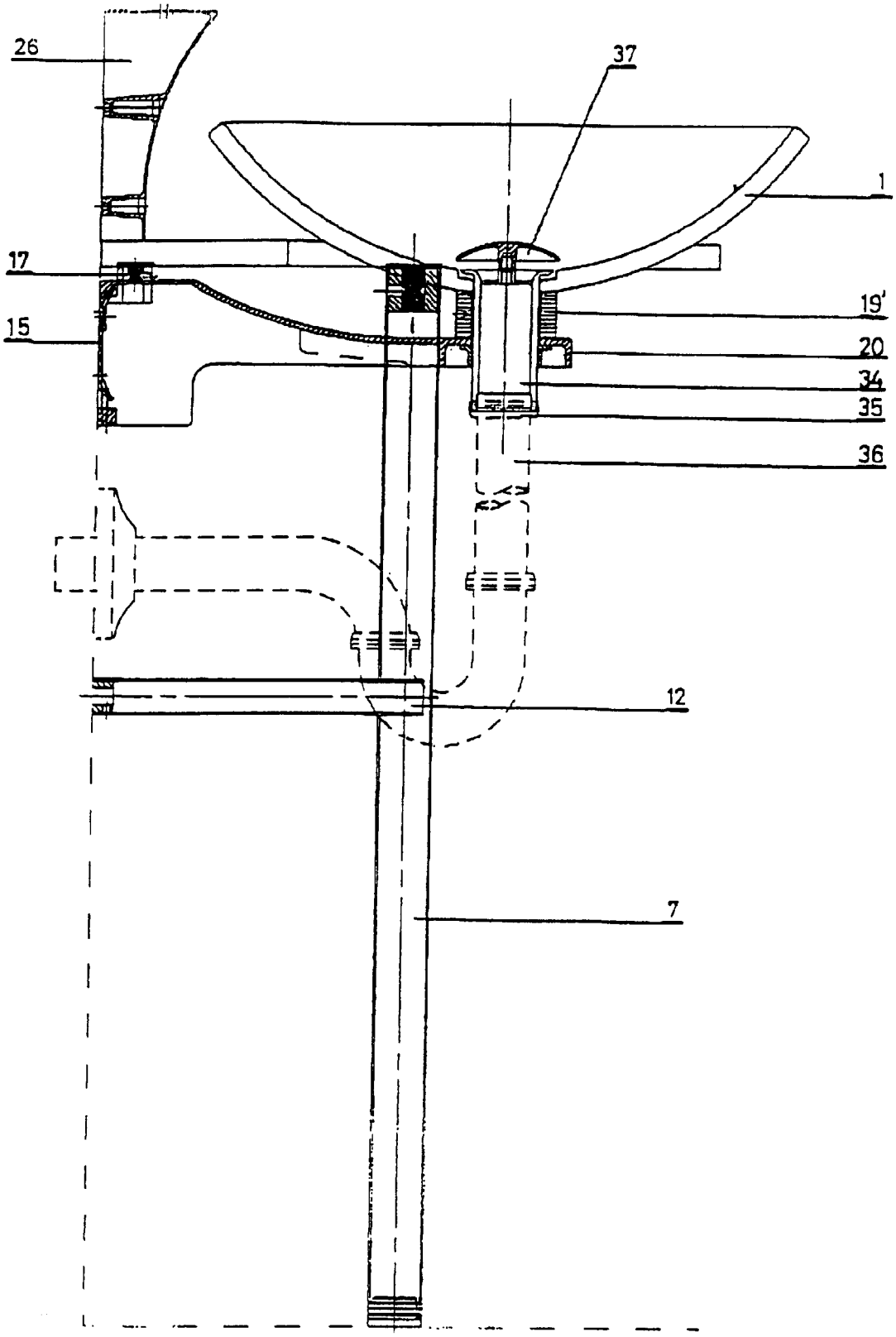
FIG. 8: Variant for mounting a deep basin, with cut-out countertop, legs and bracket, in elevation, sectioned along several vertical planes.
Figure 13:
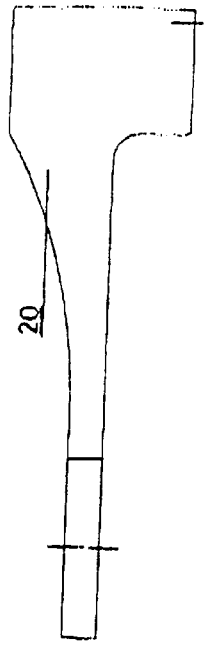
FIGS. 9 through 14: Support bracket for deep basin, with cut-out countertop and legs.
Figure 12:
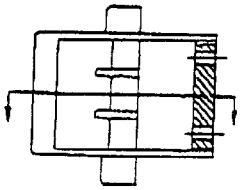
Figure 14:
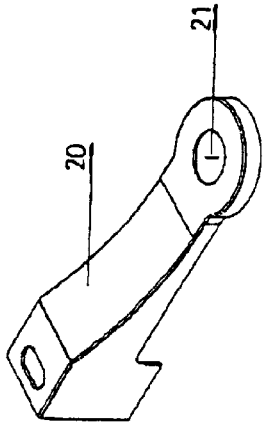
Figure 9:
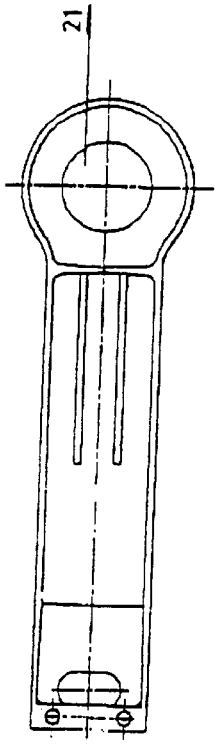
Figure 10:
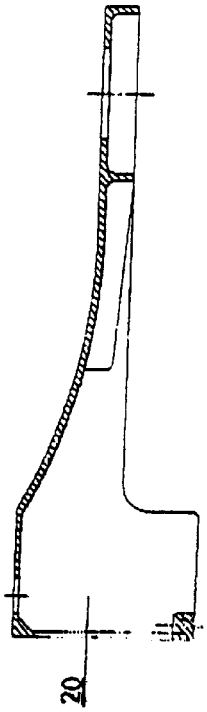
Figure 11:
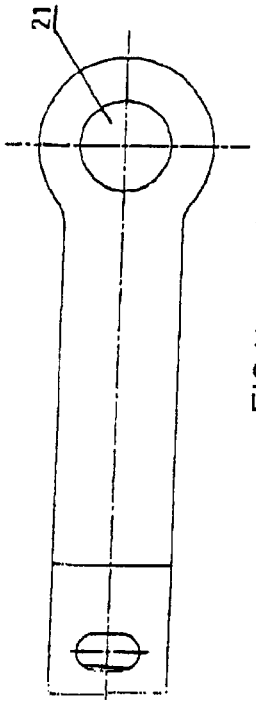
Figure 15:
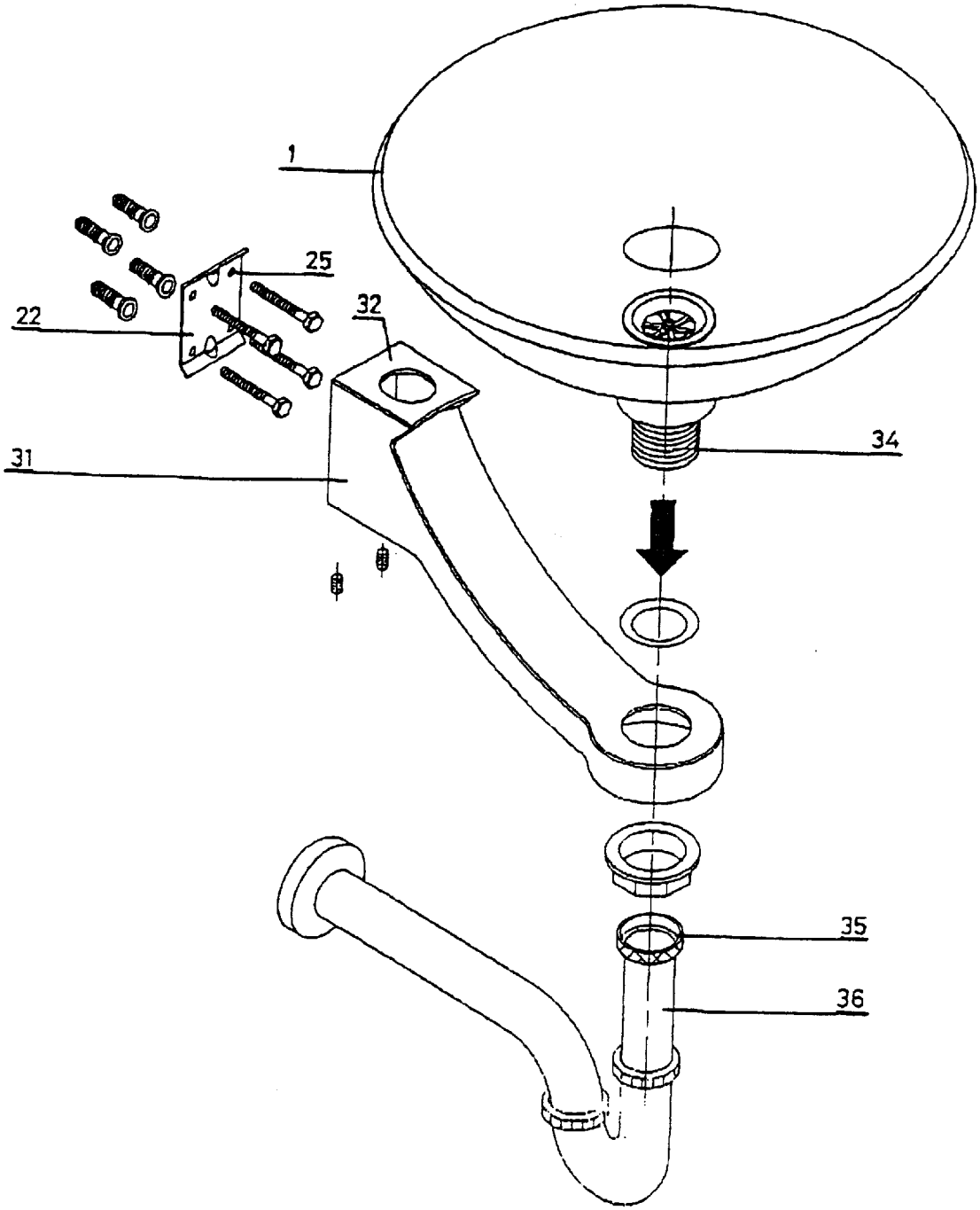
FIG. 15: Variant for mounting deep, free-standing basin (without countertop or legs), disassembled.
Figure 20:
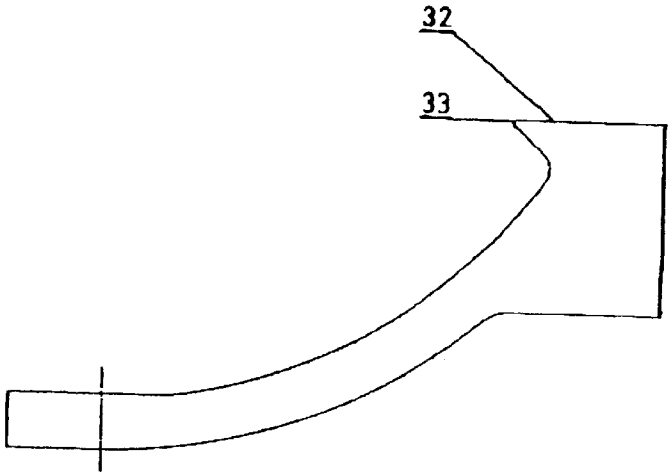
FIGS. 16 through 21: Support bracket for deep or shallow basin, in free-standing mounting (without countertop or legs).
Figure 19:
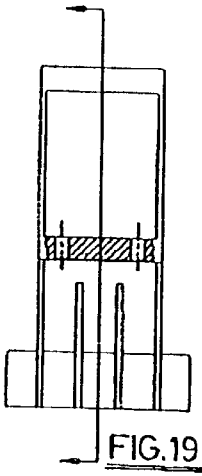
Figure 21:
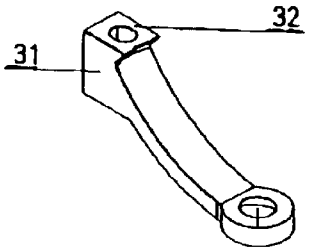
Figure 16:
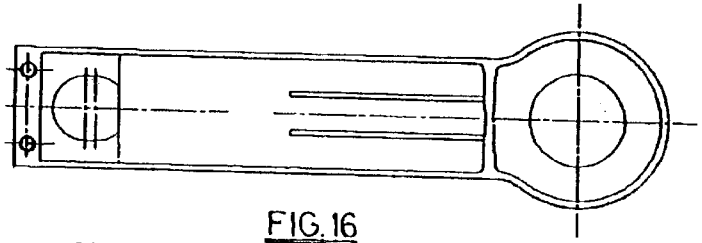
Figure 17:
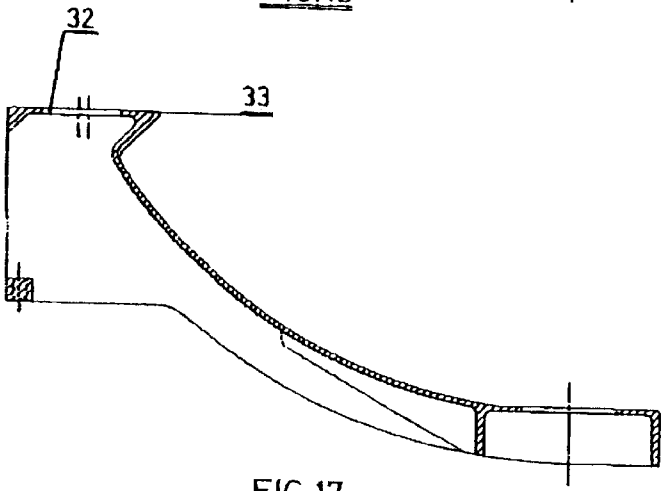
Figure 18:
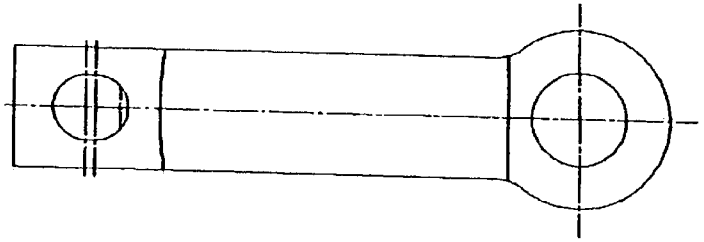
Figure 26:
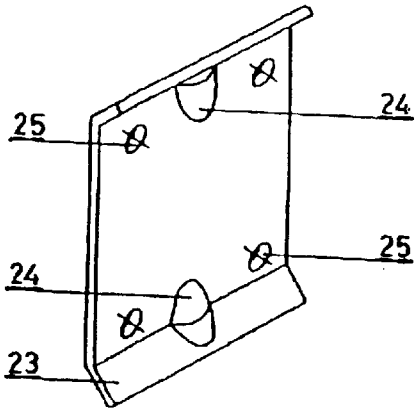
FIGS. 22 through 26: Attachment member for attaching the support bracket to the wall.
Figure 25:
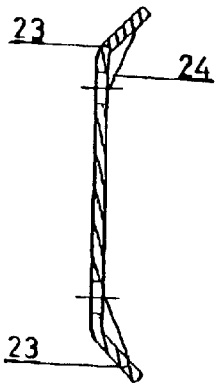
Figure 24:
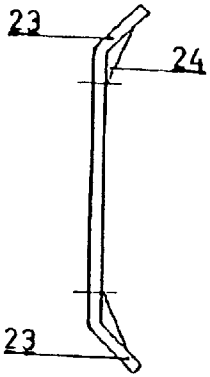
Figure 22:
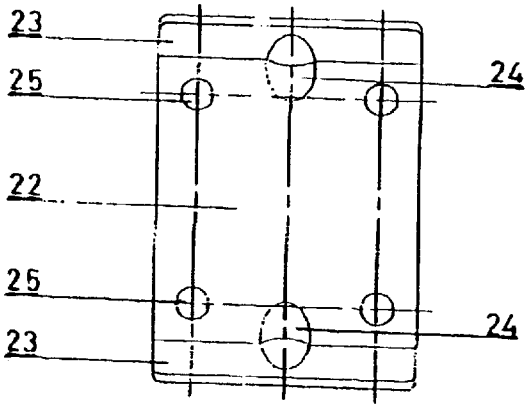
Figure 23:
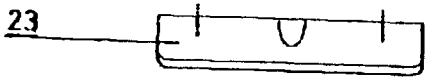
Figure 27:
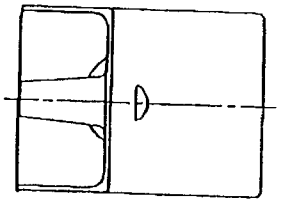
FIGS. 27 through 33: Support for single-mount faucet.
Figure 28:
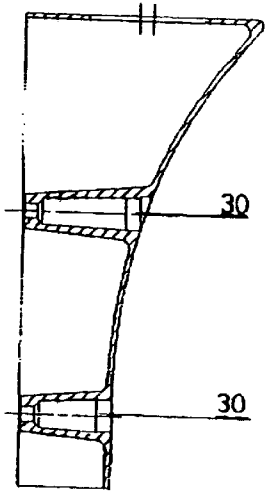
Figure 29:
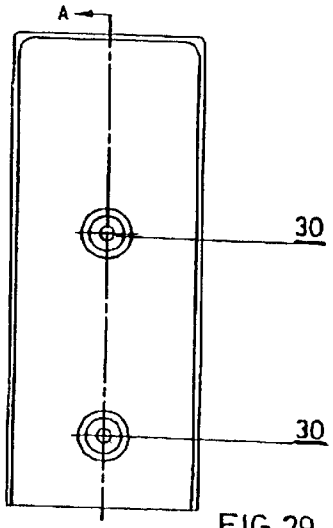
Figure 30:
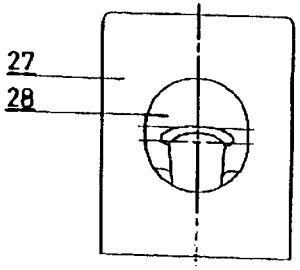
Figure 31:
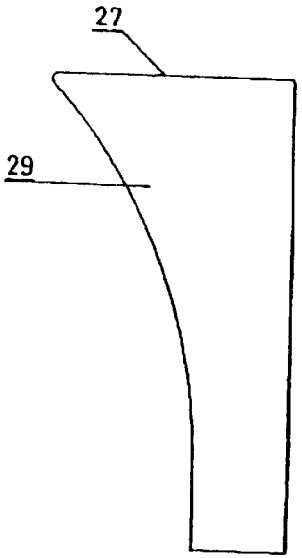
Figure 32:
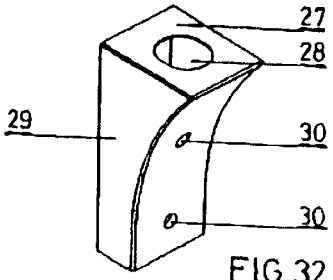
Figure 33:
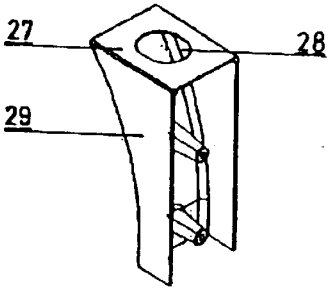
Figure 34:
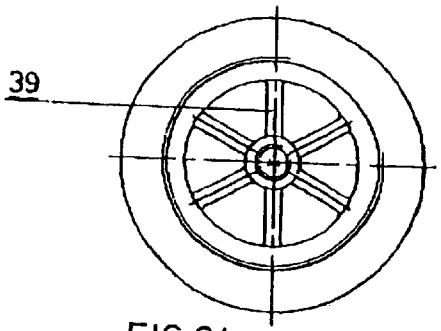
FIGS. 34 through 37: Cylindrical, tubular outlet.
Figure 35:
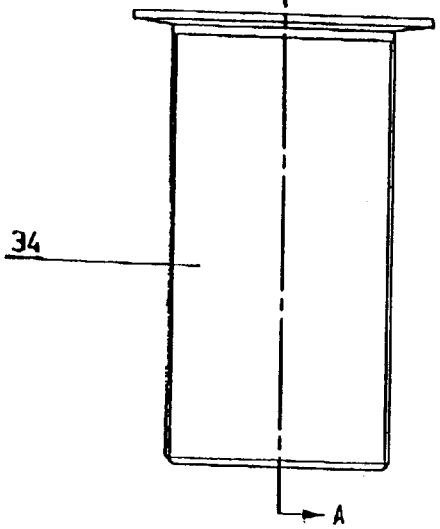

These supports are also used to affix the brackets to the wall in the case of deep basins with cut-out countertops (FIG. 8).

Only for use with straight countertops

A vertical, cylindrical, tubular support (19), the upper end of which supports the basin at the center of its outer face (outlet) and the opposite end of which rests on the countertop.

Only for use with cut-out countertops, on legs

A central bracket (20) (FIGS. 9 through 14) to support the basin from underneath the countertop, where it has its incomplete circumferential hollowed-out approach. On the projecting flange, the upper face of which is arched concavely, it has a circular end perforation (21) for the drain to pass through, and its vertical face placed against the wall is hollow and affixed to it by means of a special member.

A special member (22) (FIGS. 22 through 26), shaped like a flat rectangle for affixing basin support brackets to the wall, with its shorter sides (23) bent to form obtuse angles and in the center of its edge there is a reinforcement projection (24) and in the proximity of the vertices of the planar face there are two holes (25) through which the fastening screws are inserted, with the downward extension (15) of the inner shank (16) of the inverted, U-shaped supports interspaced between the wall and the member (22), with its hole coinciding with one of the upper holes of the member (22) such that the same screw can fasten both the member (22) as well as the support to the wall.

A vertical, cylindrical, tubular support (19'), on one end of which the basin is supported at the center of its outer face (outlet) and the opposite end of which is supported on the horizontal end of the flange of the bracket (20).

Only for use with a straight or cut-out countertop, with front edges curved convexly A three-body stand in which the two ends are symmetrically inverse, each one having a drawer in the upper portion and a cabinet in the lower portion, and they are joined at the central body, the upper plane of which is slightly lower than that of the end bodies.

The back plane of the stand is adapted to the facing of a wall and its lateral planes are perpendicular to the back, while its front is curved convexly at its two end bodies and is vertically flat in its central body.

A vertical, cylindrical, tubular support, on one end of which is supported the basin at the center of its outer face (outlet) and the opposite end of which is supported on the upper face of the central body of the stand, and it can be of two different heights: a short support for a deep basin and long support for a shallow basin.

Two identical cylindrical supports, on one end of which rests the countertop and whose opposite ends support the center of each of the two end bodies of the stand, keeping the countertop spaced apart from the upper plane of the stand and parallel to it.

For use with any type of countertop

A support for faucet fixtures (26) (FIGS. 27 through 33), formed by: a flat upper face (27) that is rectangular and horizontal, with a large, central opening (28) for affixing a single-handle faucet; two flat, vertical, tapering, lateral faces (29), whose longer straight side is placed against the wall, the intermediate side of which extends along the upper face (27) and the short side of which extends along the open base; the front face is arched concavely and has two through-holes (30) through which are inserted two screws that affix it to the wall.

Only for use without countertops (free-standing basins)

A support bracket (31) (FIGS. 16 through 21) similar to the one (20) described under C, but with the upper face of the projecting flange having greater concavity, with reinforcing ribs on its lower face, the higher flat branch (32) of said upper face having a larger surface area and a small projection (33) extending over its concavity.

C)—Aesthetic Components

To improve the aesthetic appearance of the assemblage, the stand comprises the following elements:

Only for use with countertops on legs or free-standing basins

A cylindrical, tubular outlet (34) (FIGS. 34 through 37) on the lower end of which a tubular piece (36) leading to the trap is pressure-connected with a peripheral seal (35).

Figure 38:
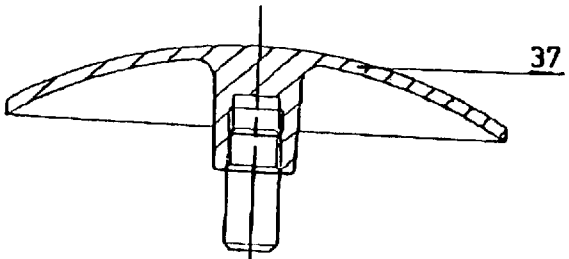
FIG. 38: Cap to mask the basin's outlet opening. Diametrical section.
Figure 36:
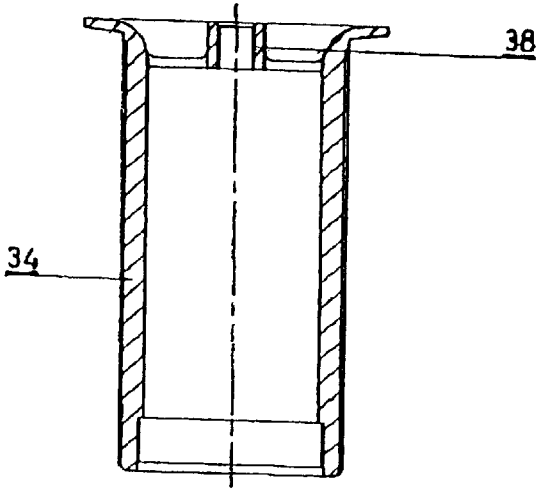
Figure 37:
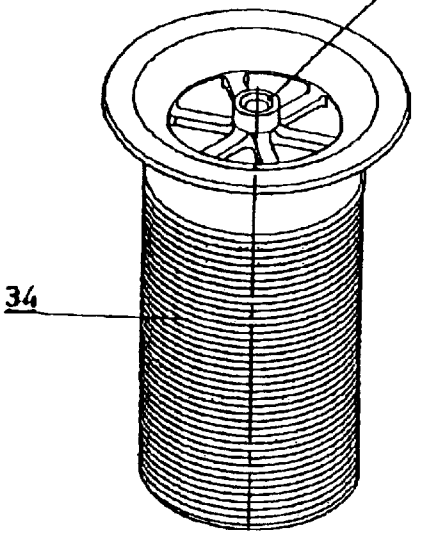

A cap (37) (FIG. 38) to mask the basin's outlet opening, in the shape of a concave disk detachably connected to a socket (38) disposed in the center of the radii (39) within the delimitation of the outlet.

What is claimed is:

1. Assembly for washstand, with preferred application into a complete unit, characterized by comprising the following functional components: A basin assuming the configuration of a shell with spherical surface with its concavity facing upwardly, in two distinct shapes for alternative use: one (1) (FIG. 8) of lesser maximum diameter and greater depth (deep); and the other (2) (FIG. 1) of greater maximum diameter and lesser depth (shallow); and a planar countertop, disposed horizontally, wider than it is deep, with its back edge straight, its lateral edges perpendicular to the back and its front edge having one of the following four alternative configurations: straight (3) (FIG. 1), parallel to the back edge; or with a straight, central, recessed section (4); and the ends (5) curved convexly and identical; or one of the two preceding ones (straight countertops) with an incomplete circumferential hollowed-out approach (6) (FIG. 8) in the center (cut-out countertops).

2. Assembly for washstand, according to claim 1, characterized by the fact that, in order to support the functional components, it comprises mechanical elements such that whatever type of countertop is used, the stand has two vertical, cylindrical, tubular legs (7) (FIG. 6) disposed in the longitudinal axis of the countertop perpendicular to its plane, at its lower face in the proximity of its lateral edges, affixed to it by means of lugs (8) joined to said lower face, which are inserted into sockets (9) that hold the upper ends of the legs (7) and retain them by means of set screws (10)

engaging grooves (11) around the perimeter of the lugs (8); each leg is provided with a horizontal, cylindrical, tubular cross piece (12) (FIG. 7) of lesser diameter than the leg and with one of the ends of the cross piece introduced into the leg, while the other is supported against the wall, bracing the assemblage, two compound profile supports (FIGS. 2, 3 and 4), whose cross section is in the form of an inverted "U" (13), the inner shank of which extends outwardly and downwardly in a double right angle, affixed to the wall by two fasteners (14) through the downward extension (15) of the inner shank (16) of the "U," and which are joined to the lower face of the countertop by means of lugs (17) (FIG. 5) affixed to it, which are inserted into an opening (18) of the central section of the "U" and retained by set screws (10) engaging grooves (11) around the perimeter of the lugs (17); these supports can also be used to affix the support brackets to the wall in the case of deep basins with cut-out countertops (FIG. 8).

3. Assembly for washstand, according to claim 1, characterized by the fact that, in order to support the functional components, it comprises mechanical elements such that, if it is used solely for straight countertops, it comprises a vertical, cylindrical, tubular support (19), the upper end of which supports the basin at the center of its outer face (outlet) and the opposite end of which is supported on the countertop.

4. Assembly for washstand, according to claim 1, characterized by the fact that, in order to support the functional components, it comprises mechanical elements such that if it is used solely for cut-out countertops on legs, it comprises a central bracket (20) (FIGS. 9 through 14) to support the basin from underneath the countertop, where it has its incomplete circumferential hollowed-out approach, on the projecting flange, the upper face of which is arched concavely, it has a circular end perforation (21) for the drain to pass through, and its vertical face, placed against the wall, is hollow and affixed to it by means of a special member; a special member (22) (FIGS. 22 through 26) for affixing basin support brackets to the wall, shaped like a flat rectangle, with its shorter sides (23) bent to form obtuse angles, in the center of which is a reinforcement projection (24) and in the proximity of the vertices of the planar face are two holes (25) through which the fastening screws pass, with the downward extension (15) of the inner shank (16) of the supports in the form of an inverted U interspaced between the wall and the member (22), with its hole coinciding with one of the upper holes of the member, (22) such that the same screw can join both the member (22) and the support to the wall; and a vertical, cylindrical, tubular support (19'), on one of the ends of which the basin is supported at the center of its outer face (outlet) and the opposite end of which is supported on the horizontal end of the flange of the bracket (20).

5. Assembly for washstand, according to claim 1, characterized by the fact that, in order to support the functional components, it comprises mechanical elements such that if it is used solely for a straight or cut-out countertop with convexly curved front edges, it comprises a three-body stand in which the two ends are symmetrically inverse, each provided with a drawer in the upper portion and a cabinet in the lower portion and joined at the central body whose upper plane is slightly lower than that of the end bodies, the stand being adapted with its back plane to the facing of a wall and its lateral planes perpendicular to the back, while its front is curved convexly at its two end bodies and vertically flat in its central body; a vertical, cylindrical, tubular support, on one end of which is supported the basin at the center of its outer face (outlet) and the opposite end of which is supported on the upper face of the central body of the stand and can assume two distinct heights: a short support for a deep basin and long support for a shallow basin; and two identical cylindrical supports, on one of the ends of which rests the countertop and the opposite ends of which support the center of each of the two end bodies of the stand, keeping the countertop spaced apart from the upper plane of the stand and parallel to it.

6. Assembly for washstand, according to claim 1, characterized by the fact that, in order to support the functional components, it comprises mechanical elements such that if it is used for any type of countertop, it comprises a support for faucet fixtures (26) (FIGS. 27 through 33), formed by: a flat upper face (27) that is rectangular and horizontal, with a large, central opening (28) for affixing a single-handle faucet; two flat, vertical, tapering, lateral faces (29), the longer straight side of which is placed against the wall, the intermediate side of which extends along the upper face (27) and the short side of which extends along the open base; the front face is arched concavely and has two through-holes (30) for holding two screws for affixing it to the wall.

7. Assembly for washstand, according to claim 1, characterized by the fact that, in order to support the functional components, it comprises mechanical elements such that if it is used for free-standing basins, it comprises a support bracket (31) (FIGS. 16 through 21) similar to the one (20) described under C, but with the upper face of the projecting flange having greater concavity, with reinforcing ribs on its lower face; the higher flat section (32) of said upper face having a larger surface area and a small projection (33) extending over its concavity.

8. Assembly for washstand, with preferred application into a complete unit, characterized by the fact that, in order to support the functional components, it comprises mechanical elements such that, whatever type of countertop used, the stand has two vertical, cylindrical, tubular legs (7) (FIG. 6) disposed in the longitudinal axis of the countertop perpendicular to its plane, at its lower face in the proximity of its lateral edges, affixed to it by means of lugs (8) joined to said lower face, which are inserted into sockets (9) that hold the upper ends of the legs (7) and retain them by means of set screws (10) engaging grooves (11) around the perimeter of the lugs (8); each leg is provided with a horizontal, cylindrical, tubular cross piece (12) (FIG. 7) of lesser diameter than the leg and with one of the ends of the cross piece introduced into the leg, while the other is supported against the wall, bracing the assemblage, two compound profile supports (FIGS. 2, 3 and 4), whose cross section is in the form of an inverted "U" (13), the inner shank of which extends outwardly and downwardly in a double right angle, affixed to the wall by two fasteners (14) through the downward extension (15) of the inner shank (16) of the "U", and which are joined to the lower face of the countertop by means of lugs (17) (FIG. 5) affixed to it, which are inserted into an opening (18) of the central section of the "U" and retained by set screws (10) engaging grooves (11) around the perimeter of the lugs (17); these supports can also be used to affix the support brackets to the wall in the case of deep basins with cut-out countertops (FIG. 8).

9. Assembly for washstand, according to claim 8, characterized by the fact that, in order to support the functional components, it comprises mechanical elements such that, if it is used solely for cut-out countertops on legs, it comprises a central bracket (20) (FIGS. 9 through 14) to support the basin from underneath the countertop, where it has its incomplete circumferential hollowed-end approach, on the projecting flange, the upper face of which is arched concavely, it has a circular end perforation (21) for the drain to pass through, and its vertical face, placed against the wall, is hollow and affixed to it by means of a special member; a special member (22) (FIGS. 22 through 26) for affixing basin support brackets to the wall, shaped like a fiat rectangle, with its shorter sides (23) bent to form obtuse angles, in the center of which is a reinforcement projection (24) and in the proximity of the vertices of the planar face are two holes (25) through which the fastening screws pass, with the downward extension (15) of the inner shank (16) of the supports in the form of an inverted U interspaced between the wall and the member (22), with its hole coinciding with one of the upper holes of the member (22), such that the same screw can join both the member (22) and the support to the wall; and a vertical, cylindrical, tubular support (19'), on one of the ends of which the basin is supported at the center of its outer face (outlet) and the opposite end of which is supported on the horizontal end of the flange of the bracket (20).

10. Assembly for washstand, according to claim 8, characterized by the fact that, in order to support the functional components, it comprises mechanical elements such that, if it is used for any type of countertop, it comprises a support for faucet fixtures (26) (FIGS. 27 through 33), formed by: a flat upper face (27) that is rectangular and horizontal, with a large, central opening (28) for affixing a single-handle faucet; two flat, vertical, tapering, lateral faces (29), the longer straight side of which is placed against the wall, the intermediate side of which extends along the upper face (27) and the short side of which extends along the open base; the front face is arched concavely and has two through-holes (30) for holding two screws for affixing it to the wall.

* * * * *